United States Patent [19]

Lang

[11] Patent Number: 4,604,885

[45] Date of Patent: Aug. 12, 1986

[54] MACHINE FOR THE BENDING OF STRANDED MATERIAL

[76] Inventor: Thomas P. Lang, Erbacher Strasse 45, D-6120 Michelstadt, Fed. Rep. of Germany

[21] Appl. No.: 594,485

[22] Filed: Mar. 27, 1984

[30] Foreign Application Priority Data

Mar. 31, 1983 [DE] Fed. Rep. of Germany ..... 3311766

[51] Int. Cl.[4] ..... B21D 7/022

[52] U.S. Cl. ..... 72/306; 72/384; 72/388

[58] Field of Search ..... 72/305-307, 72/323, 387, 388, 149, 321; 140/105

[56] References Cited

U.S. PATENT DOCUMENTS

| | | | |
|---|---|---|---|
| 2,964,085 | 12/1960 | Ghiringhelli | 72/388 |
| 3,245,433 | 4/1966 | Taylor, Jr. | 72/149 |
| 3,373,587 | 3/1968 | Shubin et al. | 72/7 |
| 3,438,237 | 4/1969 | Sisler | 72/305 |
| 3,493,016 | 2/1970 | Ott | 72/7 |

FOREIGN PATENT DOCUMENTS

| | | | |
|---|---|---|---|
| 659978 | 3/1963 | Canada | 72/307 |

OTHER PUBLICATIONS

Data sheet on "Langbow Multiplane Tube Bending Machine", Model TM32-5AX, Russel-Bowen Systems.

Data sheet on "Curvadora Vertical Hidraulica de CN con 2 Cabezas y 5 Ejes de Coordenadas", Model A 30 CN, Curvatubi b.l.m.

*Primary Examiner*—Daniel C. Crane

*Attorney, Agent, or Firm*—Wenderoth, Lind & Ponack

[57] ABSTRACT

A machine for bending elongate material, more particularly tubular members such as brake lines, fuel lines or the like, includes a central clamping device for the elongate material. Bending heads are located on opposite sides of the clamping device, in opposite directions along the axis of the unbent elongate material. Each of the bending heads has a bending die and a counterpressure die that can be swivelled around the axis of the bending die. The bending heads can be moved independently of one another along the axis of the elongate material and can be swivelled around the axis of the elongate material so as to rotate the respective bending planes formed by the respective bending dies and counterpressure dies.

8 Claims, 6 Drawing Figures

MACHINE FOR THE BENDING OF STRANDED MATERIAL

BACKGROUND OF THE INVENTION

The invention relates to a machine for the bending of elongate material, more particularly tubular members such as brake lines, fuel lines and the like, with a central clamping device for the elongate material and with a bending head on either side of the clamping device that can be moved longitudinally along the axis of the unbent elongate material (elongate-material axis). Each bending head has a bending die designed, for example, as a bending roll and a counterpressure die that can be swivelled in a common bending plane around the axis of the respective bending die (bending-die axis) and, for example, designed as a counterpressure roll.

Machines of this type, e.g., for the bending of wheelbarrow frames or for other tubular structures with mirror symmetry, are known. In this case, the particular elongate material is clamped centrally in a clamping device. On either side of the central clamping device a bending head can be adjusted axially and in mirror symmetry to the central plane of the machine by means of a spindle on guide rods, so that one after the other equal bends can be made on the elongate material from the outward ends thereof to the center thereof. The bending plane of the two bending heads is vertical. In order to be able to produce bends that lie in different planes of the elongate material, the latter can be rotated about its longitudinal axis by means of a central pivot bearing in the clamping device before starting the next bend. The bends formed simultaneously left and right must, in turn, lie in a common bending plane. If bends are to be provided left and right of the clamping device that do not lie in a common bending plane, this can be done only by bending the single bends on either side of the central clamping device consecutively instead of simultaneously.

In fuel lines or the like, tubular material is employed wherein the ratio of length to diameter is considerable and which thus is difficult to handle. A feature common to bent components is that they often have a relatively long straight central section with adjoining end sections on either side that are bent in completely different ways. The single bends may be different in length, bending angle and bending plane, in that order. Therefore, the above described bending machine of known construction is unsuitable for the bending of such brake lines, fuel lines and the like. Manual bending on special single-purpose devices which is still applicable to brake lines, fuel lines and the like is possible, but also is costly and time consuming.

SUMMARY OF THE INVENTION

Therefore, the object of the invention is to improve this type of machine in such a way that it will permit fast operation by simple means even with elongate materials, particularly tubular members, that are to be bent asymmetrically, such as brake lines, fuel lines, and the like.

According to the invention, this object is achieved in that the bending heads are movable along the axis of the elongate material independently of one another and can be swivelled around the axis of the elongate material in order to rotate the bending plane formed by the respective bending die and the respective counterpressure die.

With the bending machine incorporating the invention, the elongate material remains tightly clamped during the bending operations, that is, it is non-rotatably fixed with respect to the machine bed. The bending heads, however, may form different bending planes that are independent of one another and that may also provide different bending lengths or radii of curvature independently of one another, so that on either side of the central clamping device any desired bends can be made side by side independently of one another, although the bending operations are performed simultaneously. In this way, not only is a bending machine provided that is simple of construction, but also one that has a high production rate.

The required rotation of the bending planes on either side of the central clamping device can, for example, be simply achieved structurally by placing on either side of the central clamping device swivel brackets for the bending heads. Each bracket has a swivel axis in the area of the end portions of outer and inner bracket arms coinciding with the axis of the elongate material and includes a bracket cross member parallel to the axis of the elongate material but spaced therefrom. Since the distance between the bracket cross members and the axis of the elongate material can be chosen to be relatively large, a great deal of empty space is available for the end portions of the elongate material, which thereby can be bent into very unwieldy shapes. This is not the case with the prior art bending machine due to the two guide rods and the sliding spindle for the bending heads.

The free end of each outer bracket arm can be fixedly connected to the drive shaft of a respective swing motor. By means of the particularly swing motor, the respective swivel bracket, and thereby the bending plane of the respective bending head, can be rotated through 300 degrees and more.

Preferably, a transport motor for the axial movement of the particular bending head on the bracket cross member is mounted on each swivel bracket so as to swivel therewith. Thus, costly gears, transmission or the like are avoided, since the particular transport motor can, for instance, move the associated bending head axially along the particular bracket cross member by means of threaded spindles known from the prior art.

A robust design of the bending machine is achieved by swivel-mounting the particular swivel bracket between a central and an outer supporting bracket of the machine bed.

Advantageously, the two swivel brackets are swivel-mounted on a common central supporting bracket that also supports the clamping device.

The particular bending head may be placed on a holding fixture that also supports the drive motor for the bending die and/or the counterpressure die and that is mounted on the bracket cross member of the particular swivel bracket with allowance for sliding in the axial direction. This, too, promotes the goal of a simple design.

On each of the outer supporting brackets one can, for example, mount an axially adjustable limit stop. These limit stops can, for one thing, serve to position the elongate material in its starting position. However, the particular limit stop can also deliver a position signal to a program control of the process for swivelling the particular bending head and which is dependent upon its relative axial position with respect to the central clamping device. In this way, it is possible to perform certain bending operations by means of a standard bending program.

During the bending of the elongate material, the particular bending head is preferably located in its starting position immediately adjoining the central clamping device. Then, it first moves axially outwardly along the elongate material, and then axially inwardly, during which the individual bending operations are performed. This operating mode has the advantage that any coupling nuts that may be present on the elongate material, which is often the case with brake lines, fuel lines or the like, are inevitably moved to the extreme ends where they belong on the finished workpiece, because after the bending operation the coupling nuts, under certain conditions, can no longer be pushed to the desired extreme end positions via the bent elongate material, especially if bends of small radius of curvature are present.

The bending machine embodying the invention may also be equipped with automatic devices for the unbent elongate material and/or the removal of the finished workpieces. During feeding, the elongate material is, for example, drawn off from a coil.

Therefore, the invention has provided a multipurpose, easily automated, simply designed, high-speed bending machine which is eminently suited to the bending of complicated brake lines, fuel lines or the like, and to which all prior art bending heads and bending techniques can be applied.

BRIEF DESCRIPTION OF THE DRAWINGS

Further objects, features, advantages and uses of the invention will become apparent from the ensuing description of an embodiment thereof, with reference to the accompanying drawings. All features described and/or illustrated alone or in any meaningful combination, form the subject matter of the present invention, even independently of their combination in the claims.

In the drawings.

DETAILED DESCRIPTION OF THE INVENTION

Figure 4:
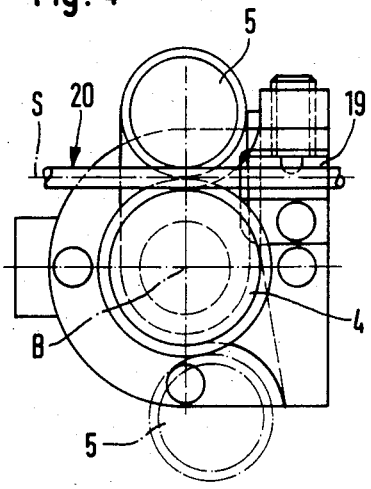
FIG. 4 is an enlarged top plan view of a bending head of the bending machine of the invention.
Figure 5:
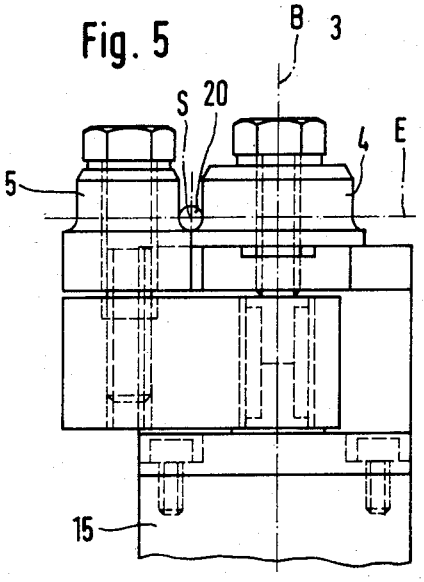
FIG. 5 is a view of the bending head of FIG. 4 in the direction of the elongate-material axis.

The graphically illustrated bending machine 1 has a central clamping device 2 for clamping a central section of a length of elongate material 20 that remains substantially straight. Sections of material 20 on opposite sides of the central section initially are straight, but are to be bent at different bending lengths, radii of curvature, and bending planes. The unbent elongate material 20 has a longitudinal elongate-material axis S. Bending heads 3, 3' are provided on opposite sides of the central clamping device 2. In the arrangement shown, each bending head 3, 3' has a bending die 4, 4' designed as a bending roll, and a counter pressure die designed as a counterpressure roll 5, 5'. In the bending heads 3, 3' shown, each counterpressure die 5, 5' can swivel or rotate around the axis B, B' of the respective bending die 4, 4' to perform a bending operation, e.g., from the upper position indicated by solid lines in FIG. 4 to the lower position thereof denoted by dashed lines. As particularly seen from FIG. 5, it is apparent that grooveless bending rolls or counterpressure rolls can be used as bending dies 4, 4' and counterpressure dies 5, 5', respectively.

Figure 6:
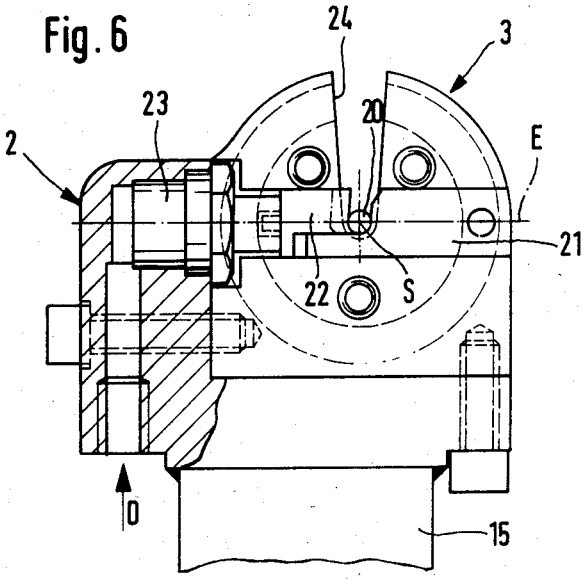
FIG. 6 is a view of a clamping device of the bending machine of the invention in the direction of the elongate-material axis.

As shown in FIG. 6, to facilitate the essentially central clamping of elongate material 20 in the clamping device 2, the latter has, for instance, a fixed clamping jaw 21 and a movable clamping jaw 22 that can be adjusted relative thereto and at right angles to the elongate-material axis S, and that can be adjusted by means of an operating piston 23 that can be charged with a pressure medium D. For a rough pre-orientation of the position of the elongate material, a slightly upwardly flared positioning slot 24 is provided in the bending head 3, on the bottom of which coact a clamping jaw 21 and a counterclamping jaw 22. Furthermore, a prop 19 is mounted on each bending head 3, 3' in the immediate vicinity of the respective bending die 4, 4' to support the elongate material 20 during the bending operation.

Figure 3:
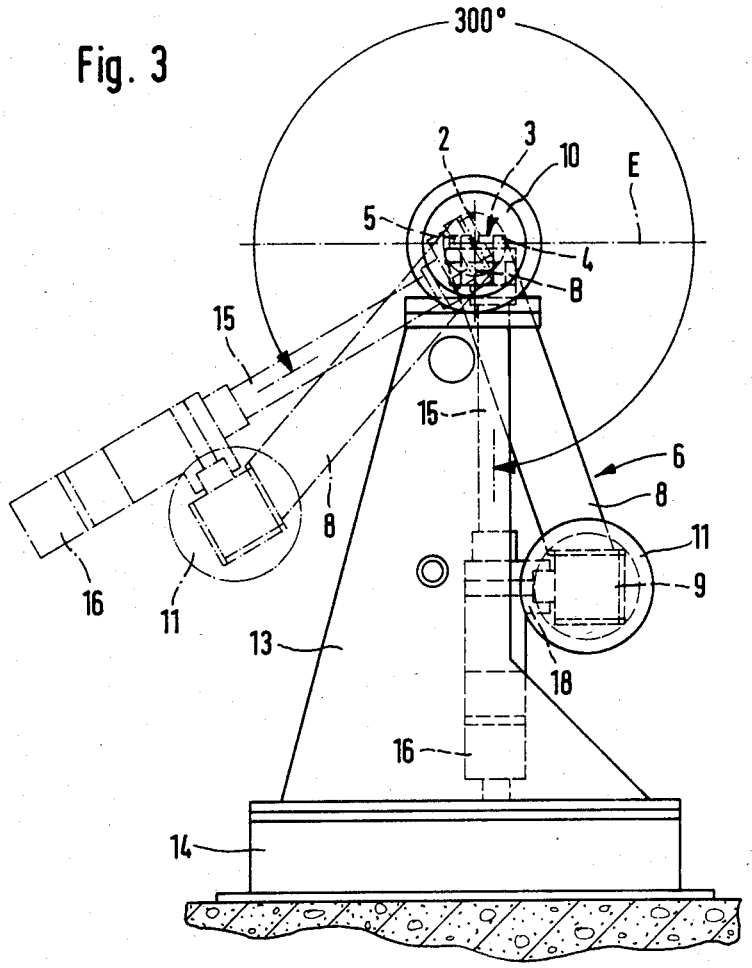
FIG. 3 is a front view of the bending machine, taken in the direction of arrow III in FIG. 1.

Each bending head 3, 3' is supported on the upper end of a holding fixture 15, 1' which has on its lower end a drive motor 16, 16' to drive the bending die 4, 4' and/or the counterpressure die 5, 5'. Holding fixtures 15, 15' together with bending heads 3, 3' and drive motors 16, 16' are mounted on bracket cross members 9, 9' of respective swivel brackets 6, 6' by means of respective base components 18, 18' with allowance for sliding in axial directions. Each bracket cross member 9, 9' has on its ends an inner substantially radial, bracket arm 7, 7' and an outer substantially radial bracket arm 8. Each inner bracket arm 7, 7' is mounted on a central supporting bracket 12 of the machine bed 14 supporting the clamping device 2 and is mounted to swivel around the elongate-material axis S. Each outer bracket arm 8, 8' is fixedly attached to the drive shaft of a respective swing motor 10, 10' which is appropriately designed to swivel the particular swivel bracket 6, 6' around the elongate-material axis S, as can particularly be seen in FIG. 3. In this way, a bending plane E that is formed by the particular bending head 3, 3' can be rotated about the elongate-material axis S so that bends can be made by the bending heads 3, 3' independently of one another in different bending planes, while the central section of material 20 remains fixedly clamped in the clamping device 2. The swing motors 10, 10 are fixedly clamped with respect to the clamping device 2 by being fixedly retained on outer supporting brackets 13, 13' of the machine bed 14.

The axial adjustment of the holding fixtures 15, 15' supporting the bending heads 3, 3' is carried out by means of transport motors 11, 11', e.g., by means of threaded spindles (not shown) acting on base components 18, 18'. The transport motors 11, 11' are mounted on the extreme ends of bracket cross members 9, 9' of the swivel brackets 6, 6' and are mounted to swivel therewith.

When clamping the elongate material 20, limit stops 17, 17' mounted with allowance for sliding axially along the outer supporting brackets 13, 13' are adjusted to the length of the particular elongate material 20. This results in the generation of electrical position signals corresponding to the location of the particular limit stops 17, 17', such signals serving as reference values for the program control for the axial movement and rotation of the bending heads 3, 3'. Thus, depending on the axial position of the elongate material 20 and on the predetermined bending program, the required bends are imparted at the proper locations on either side of the central clamping device if the bending machine is operated automatically.

Figure 1:
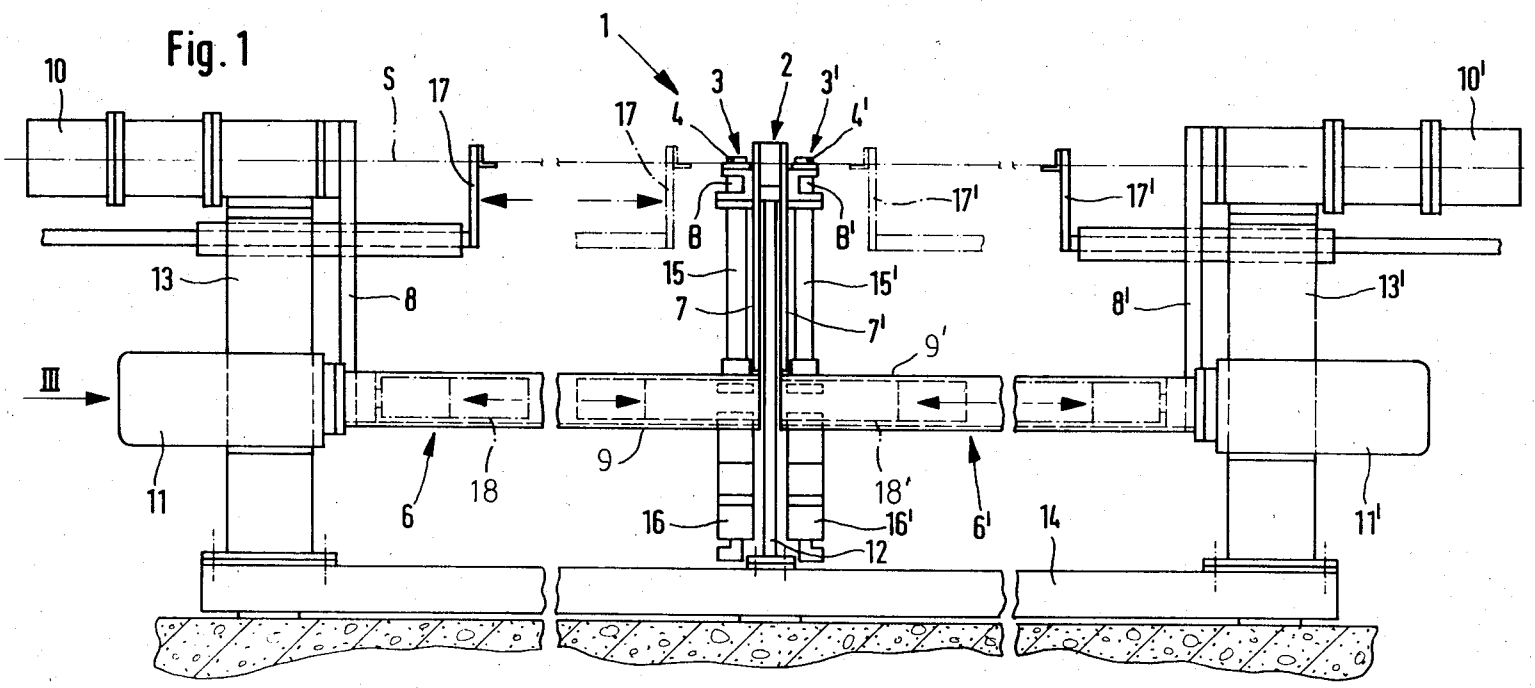
FIG. 1 is a schematic side view of a bending machine incorporating the invention.
Figure 2:
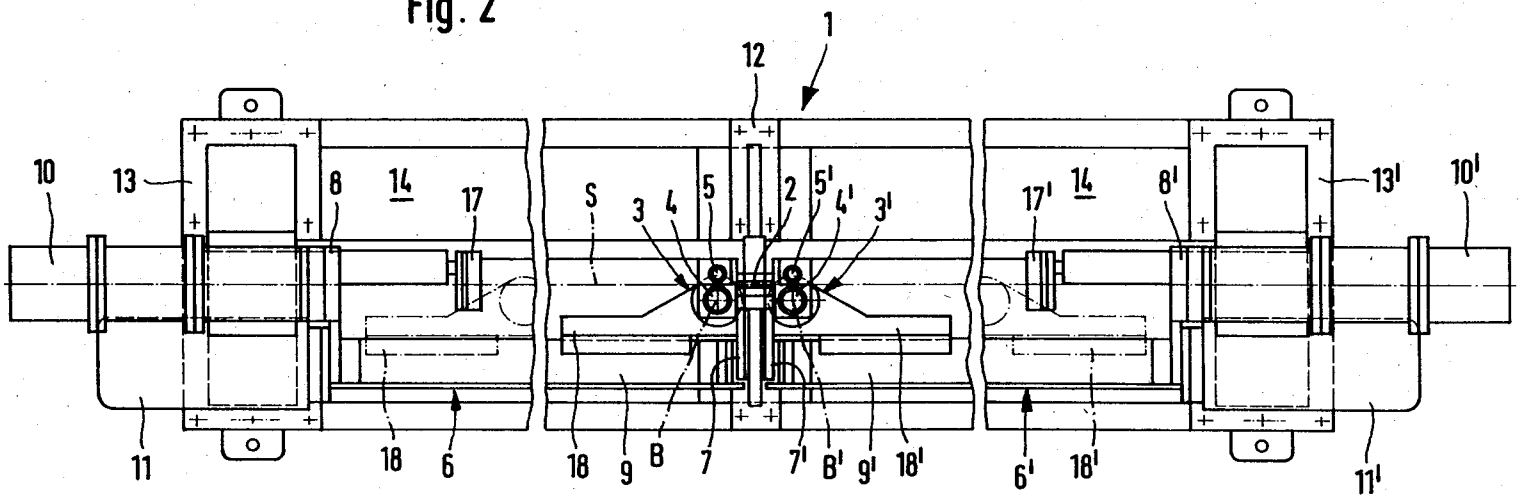
FIG. 2 is a schematic top plan view of the bending machine of FIG. 1.

When clamping the elongate material 20, the bending heads 3, 3' are in their starting position in the immediate vicinity of the central clamping device 2, as shown in FIGS. 1 and 2. Thereafter, the bending heads 3, 3' will be moved toward the extreme ends of the still-straight elongate material 20 which is to be bent by operation of the transport motors 11, 11'. During such time, any coupling nuts that may be present on the elongate material 20 are pushed to the extreme ends of the elongate material 20 where they belong on the finished workpiece. Subsequently, the individual bending operations are performed, with the bending heads 3, 3' gradually working their way axially inwardly from the opposite ends until they reach the clamped central section of the elongate material 20 that has remained straight and which is clamped in the clamping device 2.

As shown in the drawings, the bending heads 3, 3' can make bends simultaneously in different bending planes totally independently of one another, even in different bending planes, since this is solely determined by the particular swivel positions of the swivel brackets 6, 6'.

I claim:

1. A machine for bending elongate material, more particularly a tubular member such as a brake line, a fuel line or the like, said machine comprising:

fixed central clamping means for clamping a central section of an unbent elongate member and to define a fixed elongate member axis;

first and second bending heads mounted at respective sides of said clamping means, each said bending head including a bending die having a longitudinal axis, a counterpressure die spaced from said bending die such that a respective end section of the elongate member fits therebetween, and means for rotating said counterpressure die in a bending plane about said longitudinal axis of said bending die, thereby bending the respective end section; and means for swivelling each said bending head about said elongate member axis independently of said swivelling of the other said bending head, and thereby for independently rotating said bending planes with respect to said elongate member axis.

2. A machine as claimed in claim 1, wherein said swivelling means comprises, for each said bending head, a respective swivel bracket, each said swivel bracket including a cross member supporting a respective said bending head and spaced from said elongate member axis and extending parallel thereto, and axially outer and inner bracket arms supporting said cross member for rotation about said elongate member axis.

3. A machine as claimed in claim 2, wherein said swivelling means further comprises, for each said bending head, a respective swing motor having a rotatable output shaft fixedly connected to a radially inner end, with respect to said elongate member axis, of the respective said outer bracket arm, such that independent rotation of said swing motor output shafts causes independent rotation of said cross members about said elongate member axis and thereby independent swivelling of respective said bending heads about said elongate member axis.

4. A machine as claimed in claim 2, further comprising means for moving each said bending head axially of said elongate member axis independently of said axial movement of the other said bending head, said axial movement means comprising respective transport motors fixed to respective said swivel brackets to swivel therewith for moving respective said bending heads axially along respective said cross members.

5. A machine as claimed in claim 4, wherein each said swivel bracket is mounted for swivelling movement by said axially outer and inner arms thereof between respective outer and inner fixed supports of the machine.

6. A machine as claimed in claim 5, wherein said axially inner arms of both said swivel brackets are mounted on a common central fixed support which also supports said fixed central clamping means.

7. A machine as claimed in claim 5, further comprising limit stop means, mounted on each of said outer fixed supports, for determining outer end positions of the respective end sections of the elongate member and for generating signals representative thereof, thereby to initiate a program control of the operation of the machine.

8. A machine as claimed in claim 4, wherein each said bending head is mounted on a respective holding fixture supported on a respective said cross member for axial movement therealong, each said holding fixture supporting a drive motor for rotating the respective said counterpressure die about said longitudinal axis of the respective said bending die.

* * * * *